US008093790B1

(12) United States Patent
Tsao

(10) Patent No.: US 8,093,790 B1
(45) Date of Patent: Jan. 10, 2012

(54) WATERPROOF LED LAMP

(75) Inventor: Chia-Tsung Tsao, Taipei (TW)

(73) Assignee: Artled Technology Corp., Shulin, Taipei Hsien (TW)

( * ) Notice: Subject to any disclaimer, the term of this patent is extended or adjusted under 35 U.S.C. 154(b) by 0 days.

(21) Appl. No.: 12/898,355

(22) Filed: Oct. 5, 2010

(51) Int. Cl.
*H01J 1/02* (2006.01)

(52) U.S. Cl. ..... 313/46; 313/498; 313/512

(58) Field of Classification Search ..... 313/46, 313/498, 512, 317, 318.01
See application file for complete search history.

(56) References Cited

U.S. PATENT DOCUMENTS 7,969,076 B2 * 6/2011 Liu et al. ..... 313/46
2010/0102694 A1 * 4/2010 Shin ..... 313/1
2010/0301731 A1 * 12/2010 Morikawa et al. ..... 313/113
* cited by examiner

*Primary Examiner* — Vip Patel
(74) *Attorney, Agent, or Firm* — patenttm.us

(57) ABSTRACT

A waterproof LED lamp has a lamp housing, a top lid, a base and a power contact assembly. The lamp housing has an LED circuit board mounted therein. The top lid is mounted on the lamp housing and above the LED circuit board. A lid seal ring is mounted between the top lid and the lamp housing to prevent moisture from entering the lamp housing. The base has multiple LED modules mounted therein and has a base seal ring mounted between the lamp housing and the base to prevent moisture from entering the lamp housing. A heat-conducting tube is mounted inside the lamp housing. A waterproof insulation layer sheathed on the heat-conducting tube and a gasket mounted between the base and the power contact assembly prevent moisture entering the lamp housing through the power contact assembly and the base. Accordingly, an overall waterproof effect can be achieved.

20 Claims, 5 Drawing Sheets

WATERPROOF LED LAMP

BACKGROUND OF THE INVENTION

1. Field of the Invention

The present invention is related to a lamp, and more particularly to a waterproof LED lamp.

2. Description of the Related Art

Lighting is an essential part of human life. Sufficient luminance is the first criterion coming to users' mind while choosing a lamp. A lamp also has to be able to sustain all kinds of weather conditions. Among all considerations of weather influence, waterproof feature is with the highest priority. So far, incandescent light bulbs are the ones commonly used outdoors. Such type of lamps usually has a plastic casing and a partition board mounted in the plastic casing. The plastic casing serves to protect a light bulb mounted therein. The partition board is pervious to light, engages the plastic casing and faces the projecting direction of light. As the outdoor weather condition is sometimes severe, the waterproof function of the plastic casing is just fair. The sealing capability between the plastic casing and the partition board deteriorates over time or as a result of frequent disassembling and assembling. Accordingly, moisture or dust easily enters into the plastic casing and the partition board, and damages the lamp. Additionally, having high power consumption and low stability, incandescent lamps are prone to breakdowns after prolonged use. The shortcomings of the conventional incandescent lamps need to be overcome.

SUMMARY OF THE INVENTION

The objective of the present invention is to provide a waterproof LED lamp.

To achieve the foregoing objective, the A waterproof LED lamp has multiple fixing elements, a lamp housing, a base and a power contact assembly.

The lamp housing has a top lid, an upper case and a lower case. The top lid has a body and a lid seal ring. The body has a bottom, a rim, a lid groove and multiple lid fixing members. The lid groove is annularly formed in the bottom of the body. The lid fixing members are formed between the rim of the body and the lid groove. The lid seal ring is mounted in the lid groove.

The upper case has a bottom, a bottom board, an outer collar, an inner collar, an LED circuit board and multiple second upper fixing members. The bottom board has a perimeter and the bottom has a rim. The outer collar is formed on the perimeter of the bottom board. The inner collar is formed on the bottom board. The inner collar is surrounded by the outer collar to define an open chamber and has a bottom, a periphery, a top edge and multiple first upper fixing members. The top edge is closely attached to the lid seal ring. Each first upper fixing member is formed on a top edge of the inner collar and aligns with a corresponding lid fixing member of the top lid. The LED circuit board is mounted on the bottom board and located inside the open chamber. The second upper fixing members are formed on the bottom of the upper case and fastened on a corresponding lid fixing member of the top lid with a corresponding fixing element.

The lower case has a periphery, an inner wall and multiple lower fixing members. The lower fixing members are formed on and protrude inwardly from the inner wall of the lower case. Each lower fixing member corresponds to one of the second upper fixing members.

The base is hollow and has two open ends, a top edge, a bottom edge, a base groove, a base seal ring and multiple first base fixing members. The base groove is annularly formed in the top edge of the base. The base seal ring is mounted in the base groove and is closely attached to the bottom of the inner collar of the upper case. Each first base fixing member aligns with a corresponding lower fixing member and a corresponding second upper fixing member and is fastened to the corresponding lower fixing member and the corresponding second upper fixing member with a corresponding fixing element.

The power contact assembly is connected with the bottom edge of the base.

Preferably, the power contact assembly has a power contact element and a connection element. The power contact element is hollow and has a top open end and a lower end. The lower end is adapted to connect with an external power source. The connection element has a neck, an annular flange, multiple through holes and a gasket. The neck is sleeved in the lower end of the power contact element and has a top edge. The annular flange is formed on and protrudes outwardly and radially from the top edge of the neck and has a top. The through holes are formed through the annular flange. The gasket is mounted on the top of the annular flange and has multiple through holes formed through the gasket to respectively correspond to the through holes on the annular flange.

Preferably, the upper case further has an upper groove, two curved walls, at least one heat-conducting tube and at least one insulation layer. The upper groove is annularly formed in the rim of the bottom of the upper case. The two curved walls are formed on the bottom of the upper case and surrounded by the upper groove. Each curved wall has a semicircular portion and a straight portion. The semicircular portion directly faces that of the other curved wall. Each two ends of the two semicircular portions are spaced by a gap. One end of the straight portion is connected with one end of a semicircular portion and the other end of the straight portion is bent inwardly to form a hook. Each one of the at least one heat-conducting tubes has a semicircular segment, a straight segment and an insulation layer. An upper half of the semicircular segment is received in the upper groove. The straight segment is connected with the semicircular segment and attached to a corresponding straight portion through a corresponding gap. The insulation layer is sheathed on the straight segment and made from a waterproof and flexible material.

Preferably, the lower case further has a top edge and two lower grooves. The two lower grooves are formed in a top edge of the lower case to substantially form a circle aligning with the upper grooves. Each lower groove receives a lower half of the semicircular segment of a corresponding heat-conducting tube.

Preferably. the upper case further has multiple upper fins formed on the periphery of the inner collar, extending to connect with the outer collar and mutually spaced. The lower case further has multiple lower fins mounted around the periphery of the lower case and mutually spaced.

Preferably, each the lid fixing member has a through hole formed the top lid. Each first upper fixing member has a threaded hole formed through the first upper fixing member, and each fixing element is a screw screwed into the threaded hole of a corresponding first upper fixing member through the through hole of a corresponding lid fixing member so that the top lid is fastened on the top edge of the inner collar of the upper case.

Preferably, each second upper fixing member has a threaded hole formed through the second upper fixing member. Each lower fixing member has a through hole formed through the lower fixing member. Each first base fixing member has a through hole formed through the first base fixing member, and each fixing element is a screw screwed into the threaded hole of a corresponding second upper fixing member through the through hole of a corresponding first base fixing member and the through hole of a corresponding lower fixing member so that the base, the lower case and the upper case are fastened together.

Preferably, the base further has multiple second base fixing members formed on the bottom edge of the base and respectively corresponding to the through holes of the gasket. Each second base fixing member has a threaded hole formed through the second base fixing member. Each fixing elements is a screw screwed into the threaded hole of a corresponding second base fixing member through corresponding through holes of the annular flange and the gasket so that the power contact assembly is fastened on the bottom edge of the base.

Preferably, each lower fixing member has a top surface, two walls and a guide slot. The top surface has a through hole formed through the top surface. The two walls extend downwardly from two sides of the top surface. The guide slot is formed between the two walls, specifically in the inner wall of the lower case to receive a corresponding base fixing member in the guide slot.

Preferably, the top lid is made of a transparent material.

Accordingly, the waterproof LED lamp of the present invention has the following advantages and effects:

1. When the waterproof LED lamp is mounted at a lower place and the light projecting direction faces up, the lid seal ring mounted between the top lid and the upper case can prevent moisture and dust from entering the chamber of the upper case.

2. With the arrangements of the base seal ring and the insulation layers respectively sheathed on the straight segments, rain falling on the power contact assembly, the base and the lower case of the waterproof LED lamp can be prevented from entering the chamber of the upper case.

Other objectives, advantages and novel features of the invention will become more apparent from the following detailed description when taken in conjunction with the accompanying drawings.

DETAILED DESCRIPTION OF THE INVENTION

Figure 1:
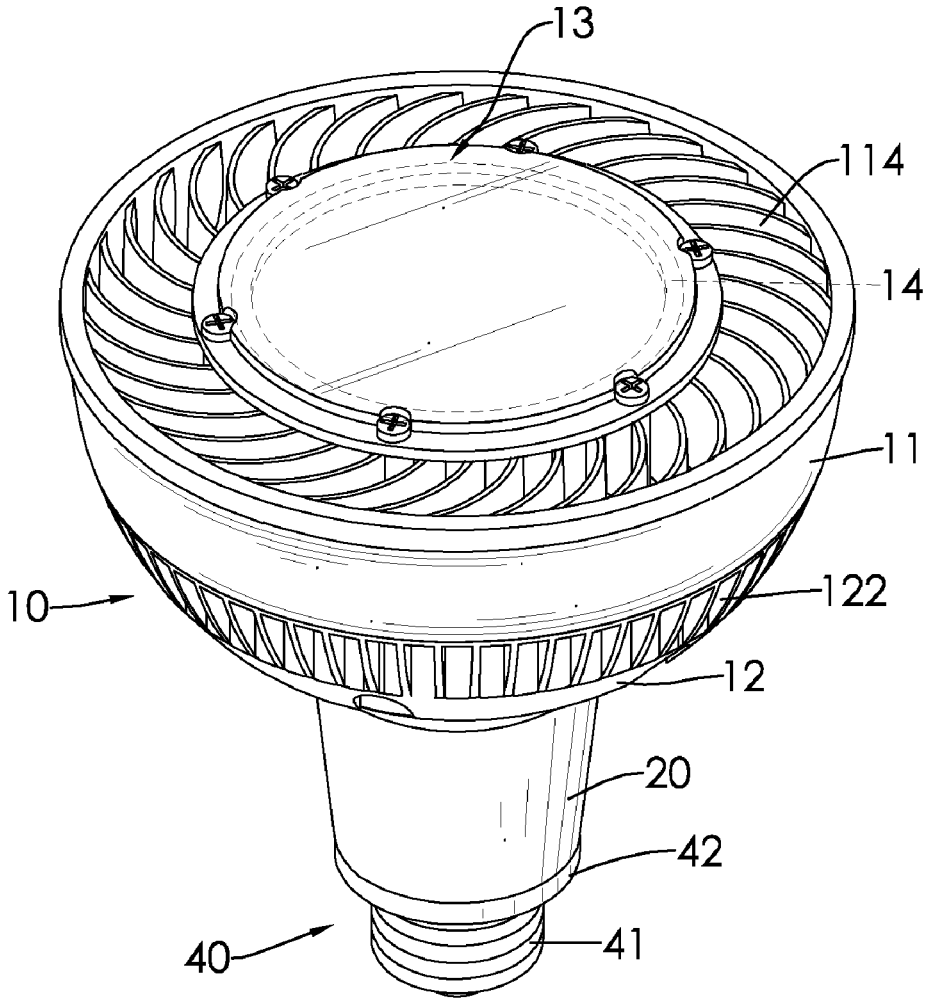
FIG. 1 is a perspective view of a waterproof LED lamp in accordance with the present invention.

With reference to FIG. 1, a waterproof LED lamp in accordance with the present invention has a lamp housing 10, a base 20 and a power contact assembly 40.

Figure 2:
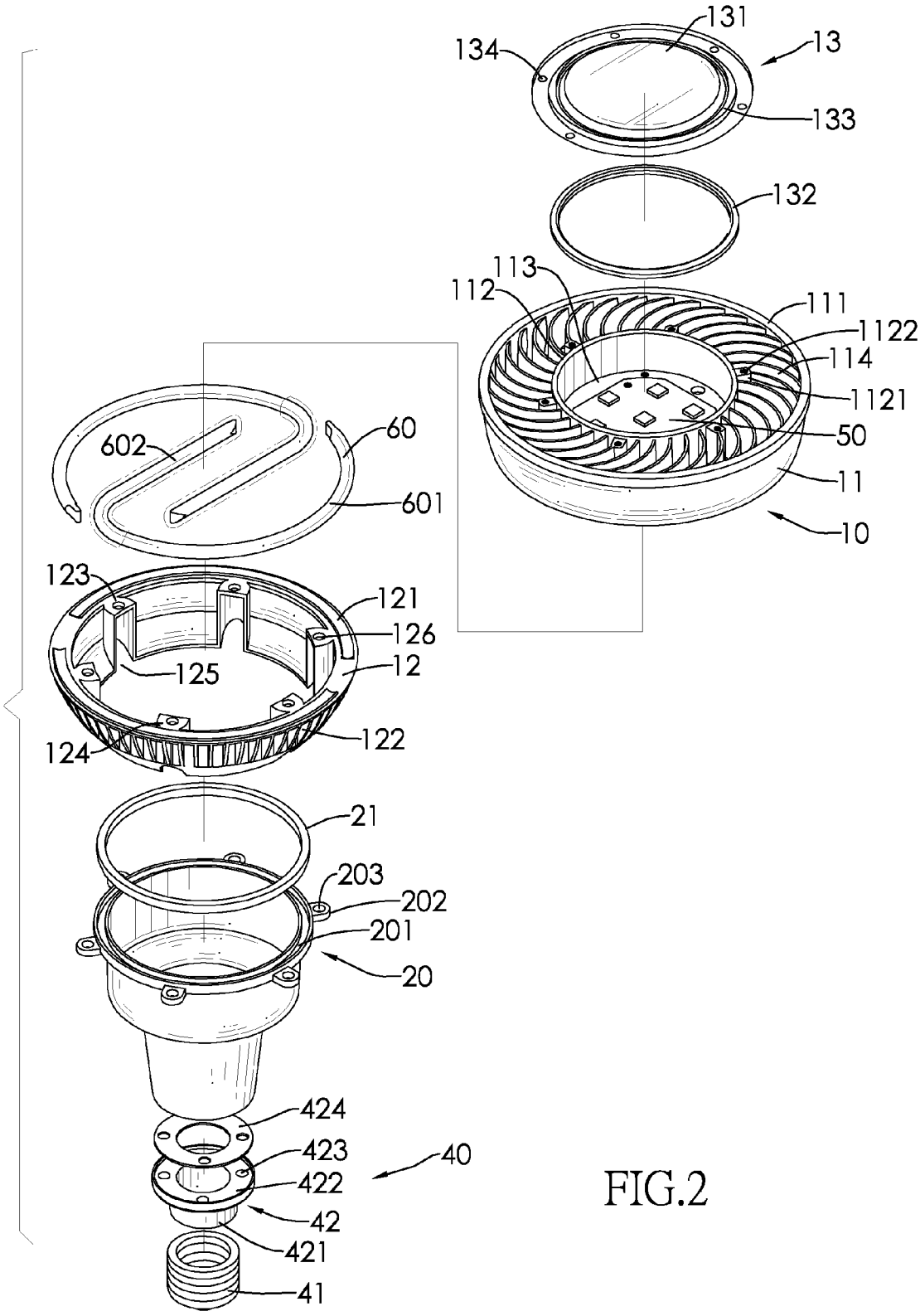
FIG. 2 is an exploded perspective view of the waterproof LED lamp in FIG. 1.
Figure 3:
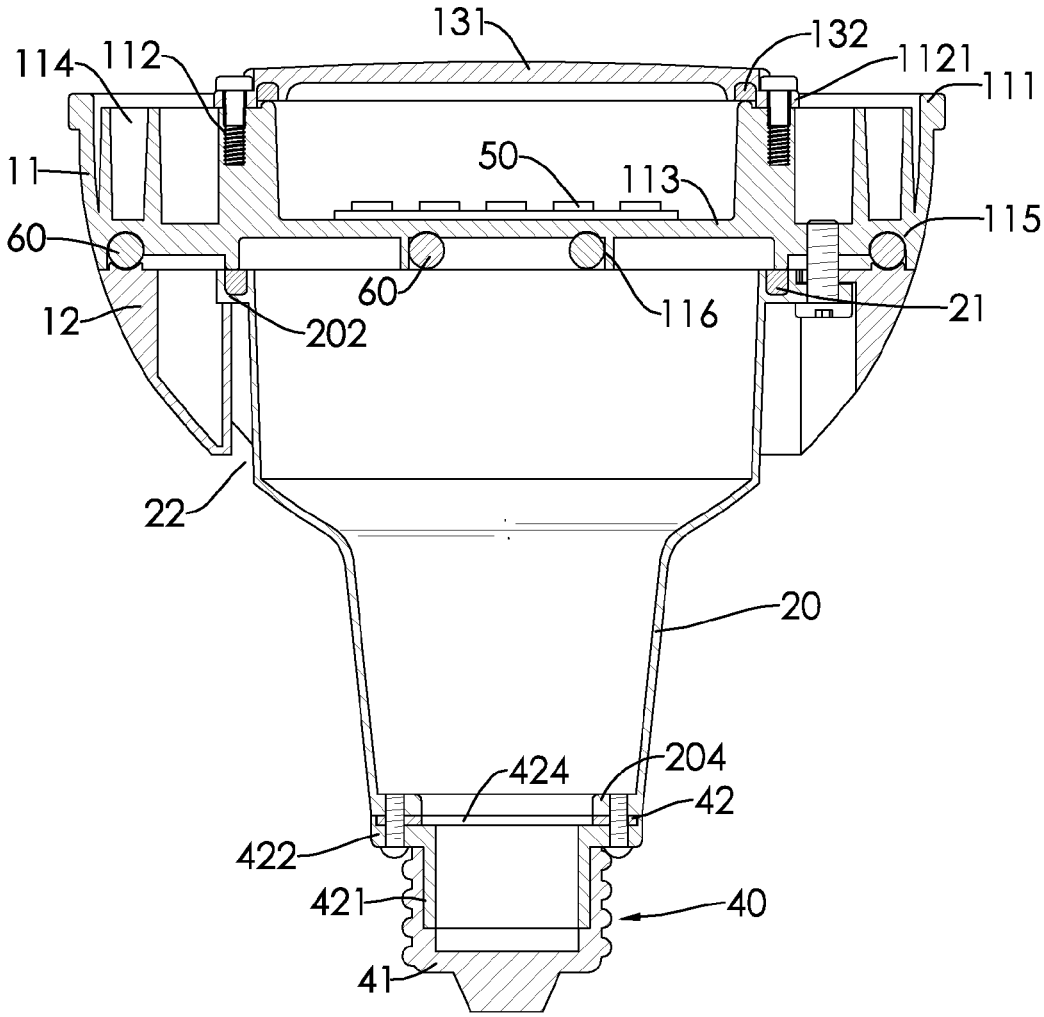
FIG. 3 is a side view in partial section of the waterproof LED lamp in FIG. 1.
Figure 4:
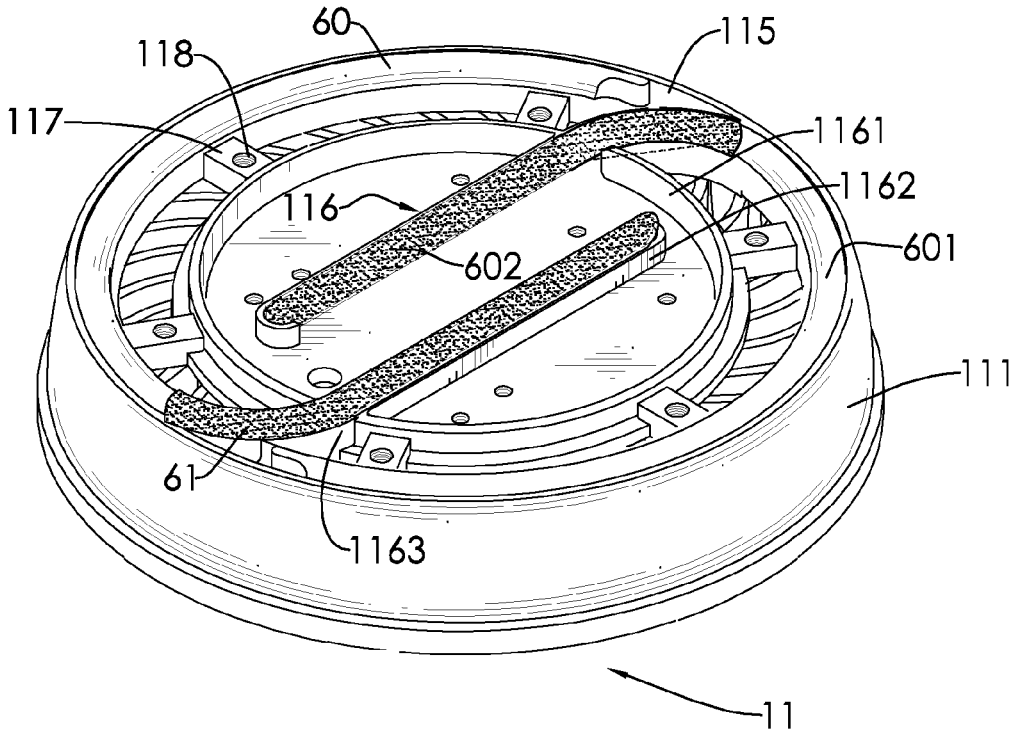
FIG. 4 is an enlarged bottom prospective view of the upper case of the waterproof LED lamp in FIG. 1.

With reference to FIGS. 2 to 4, the lamp housing 10 has an upper case 11, a lower case 12 and a top lid 13. The upper case 11 has a bottom board 113, an outer collar 111, an inner collar 112, an LED circuit board 50, multiple upper fins 114, an upper groove 115, two curved walls 116, two heat-conducting tubes 60 and multiple second upper fixing members 117. The bottom board 113 is formed on the bottom of the upper case 11 and has multiple through holes formed through the bottom board 113. The outer collar 111 is formed on a perimeter of the bottom board 113. The inner collar 112 is formed on the bottom board 113 and is surrounded by the outer collar 111. The inner collar 112 defines a chamber having an opening defined in the top of the upper case 11 and has multiple first upper fixing members 1121. Each first upper fixing member 1121 is formed on and protrudes outwardly and radially from a top edge of the inner collar 112 and has a threaded hole 1122 formed in the first upper fixing member 1121. The LED circuit board 50 is mounted inside the chamber. The LED circuit board 50 is wired through the through holes on the bottom board 113 and has multiple LEDs mounted on the LED circuit board 50 to project light outwardly. The upper fins 114 are formed on a periphery of the inner collar 112 and extend to connect with the outer collar 111 and are mutually spaced.

The upper groove 115 is annularly formed in a bottom of the upper case 11. The two curved walls 116 are formed on the bottom of the upper case 11 and surrounded by the upper groove 115, and each curved wall 116 has a semicircular portion 1161 and a straight portion 1162. The two semicircular portions 1161 of the two curved walls 116 face each other. Each two opposite ends of the two semicircular portions 1161 are spaced by a gap 1163. One end of the straight portion 1162 is connected to one end of a corresponding semicircular portion 1161 and the other end of the straight portion 1162 is bent inwardly to form a hook. Each heat-conducting tube 60 has a semicircular segment 601, a straight segment 602 and an insulation layer 61. An upper half of the semicircular segment 601 is received in the upper groove 115 and the straight segment 602 is connected with the semicircular segment 601, extends through a corresponding gap 1162 and is attached to a corresponding straight portion 1163. The insulation layer 61 is sheathed around the straight segment 602 and is made from a waterproof and flexible material so as to fully seal each gap 1162 between the two curved walls 116 by being compressed and deformed when the lower case 12 is connected securely with the upper case 11. Each second upper fixing member 117 is formed on and protrudes from a periphery of the semicircular portion 1161 of a corresponding curved wall 116 and has a threaded hole 118 formed in/through the second upper fixing member 117.

The lower case 12 has two lower grooves 121, multiple lower fins 122 and multiple lower fixing members 123. The two lower grooves 121 are formed in a top edge of the lower case 12 to substantially form a circle aligning with the upper grooves 115. A lower half of the semicircular segment 601 of each heat-conducting tube 60 is mounted in a corresponding lower groove 121. The lower fins 122 are mounted around a periphery of the lower case 12 and are mutually spaced. The lower fixing members 123 are formed on and protrude inwardly and radially from an inner wall of the lower case 12. Each lower fixing member 123 has a top surface 124 and a guide slot 125. The top surface 124 has a through hole 126 formed through the top surface 124 and corresponding to and aligning with the threaded hole 118 of a corresponding second upper fixing member 117. The guide slot 125 is formed between two walls extending downwardly from two sides of the top surface 124 of the fixing part 123 and is formed in the inner wall of the lower case 12.

The top lid 13 has a body 131 and a lid seal ring 132. The body 131 is made of a transparent material and has a lid groove 133 and multiple lid fixing members 134. The lid groove 133 is formed in a bottom of the body 131. Each lid fixing member 134 is a through hole formed through a portion between a rim of the body 131 and the lid groove 133 to align with the threaded hole 1122 of a corresponding first upper fixing member 1121 of the upper case 10. The top lid 13 is fastened on the upper case 11 by multiple fixing elements respectively mounted through the lid fixing members 134 of the top lid 13 and screwed respectively into the threaded holes 1122 of the first upper fixing members 1121 of the upper case 10. The fixing element may be a screw. The lid seal ring 132 is mounted in the lid groove 133 and abuts against the top edge of the inner wall 112 of the upper case 11.

The base 20 is hollow and has two open ends. The base 20 accommodates modules required by the LED circuit board 50. The base 20 further has a base groove 201, a base seal ring 21 and multiple first base fixing members 202. The base groove 201 is formed in a top edge of the base 20. The base seal ring 21 is mounted in the base groove 201 and abuts against the bottom edges of the two semicircular portions 1161 of the upper case 11. The first base fixing members 202 are formed on and protrude outwardly and radially from a top edge of the base. Each first base fixing member 202 has a through hole 203 formed through the tab 202 and is received in the guide slot 125 of a corresponding lower fixing member 123 of the lower case 12. The through hole 203 of each first base fixing member 202 of the base 20 aligns with the through hole 126 of the corresponding lower fixing member 123 of the lower case 12 and the threaded hole 117 of a corresponding second upper fixing member 118 of the upper case 10 so that the base 20, the lower case 12 and the upper case 10 are fastened together by multiple fixing members respectively mounted through the corresponding through holes 203 and the through holes 126 and screwed into the threaded holes 118. The base seal ring 21 on the top edge of the base 20 abuts against the bottom of the upper case 11. The base 20 further has multiple second base fixing members 204 being threaded holes and formed in a bottom edge of the base 20.

The power contact assembly 40 has a power contact element 41, a connection element 42 and a gasket 424. The power contact element 41 is hollow and has a top open end and a lower end connected with an external power source. The connection element 42 has a neck 421, an annular flange 422 and multiple through holes 423. The neck 421 is sleeved in the power contact element 41. The annular flange 422 is formed on and protrudes outwardly and radially from a top edge of the neck 421. The through holes 412 are formed through the annular flange 422 to respectively align with the screw holes on the bottom edge of the base 20. The gasket 424 is mounted on a top of the annular flange 422 and has multiple through holes formed through the annular flange 422 to respectively align with the through holes 412 on the annular flange 422 so that the power contact assembly 40 can be fastened on the bottom edge of the base 20 by multiple fixing elements respectively mounted through the through holes of the annular flange 422 and the gasket 424 and screwed into the threaded holes on the bottom edge of the base 20.

Figure 5:
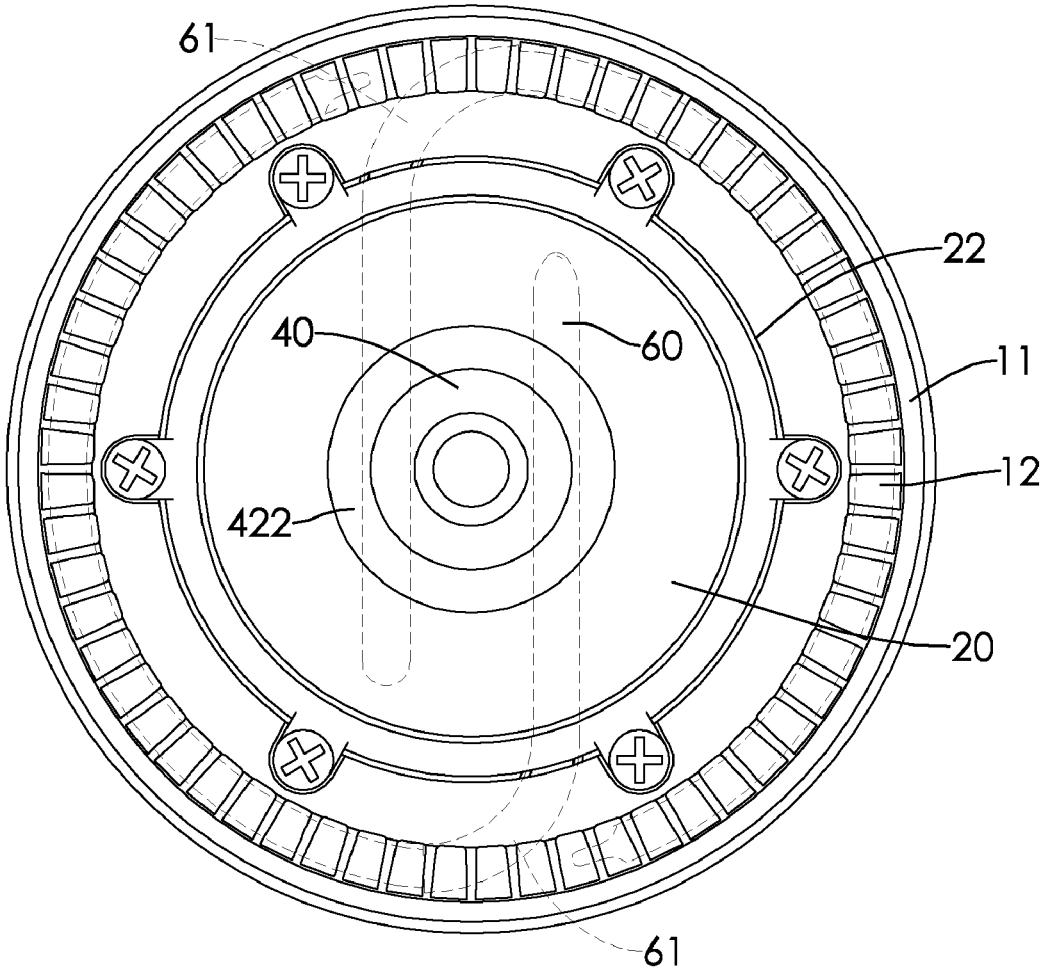
FIG. 5 is an enlarged bottom view of the waterproof LED lamp in FIG. 1.

With reference to FIGS. 3 to 5, when the waterproof LED lamp of the present invention is mounted at a low place, such as on the ground, the light emitted from the LEDs on the circuit board 50 projects upwardly and rain or dust may directly fall on the top lid 13 of the lamp housing 10. With the top lid 13 of the lamp housing 10 being fastened and covering on the inner collar 112 of the upper case 11, the lid seal ring 132 mounted on the top edge of the inner collar 112 can provide an excellent sealing effect to the inner collar 112 of the upper case 11. Thus, moisture and dust can be prevented from entering the inner collar 112 so as to protect the LED circuit board 50 received in the inner collar 112.

When the waterproof LED lamp of the present invention is mounted at a high place, such as on a streetlamp, the light emitted from the LEDs on the circuit board 50 projects downwardly and rain or dust may directly falls on the power contact assembly 40 and the base 20. With the arrangements of the base seal ring 21 and the insulation layers 61 respectively sheathed on the straight segments 602, rain entering the area between the two semicircular portions 1161 of the two curved walls 116 and the semicircular segments 601 of the two heat-conducting tubes 60 via a gap 22 between the base 20 and the lower case 12 is prevented from entering the inner wall 112 of the upper case 11 through the gaps 1162. Moreover, the gasket 424 mounted between the power contact assembly 40 and the base 20 further prevents moisture from entering through the base 20, thereby protecting the LED circuit board.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A waterproof LED lamp comprising:
multiple fixing elements;
a lamp housing having:
a top lid having:
a body having:
a bottom;
a rim;
a lid groove annularly formed in the bottom of the body; and
multiple lid fixing members formed between the rim of the body and the lid groove; and
a lid seal ring mounted in the lid groove;
an upper case having:
a bottom;
a bottom board having a perimeter and a bottom having a rim;
an outer collar formed on the perimeter of the bottom board;
an inner collar formed on the bottom board, surrounded by the outer collar to define an open chamber and having:
a bottom;
a periphery;
a top edge closely attached to the lid seal ring; and
multiple first upper fixing members, each first upper fixing member formed on a top edge of the inner collar and fastened on one of the lid fixing members of the top lid with one of the fixing elements;
an LED circuit board mounted on the bottom board and inside the open chamber; and
multiple second upper fixing members formed on the bottom of the of the upper case;
a lower case having:
a periphery;
an inner wall; and
multiple lower fixing members formed on and protruding inwardly from the inner wall of the lower case, and each lower fixing member corresponding to one of the second upper fixing members;
a base being hollow and having:
two open ends;
a top edge;
a bottom edge;
a base groove annularly formed in the top edge of the base;

a base seal ring mounted in the base groove and closely attached to the bottom of the inner collar of the upper case; and multiple first base fixing members, each first base fixing member aligning with one of the lower fixing members and a corresponding one of the second upper fixing members and fastened to the corresponding lower fixing member and the corresponding second upper fixing member with one of the fixing elements; and a power contact assembly connected with the bottom edge of the base.

2. The waterproof LED lamp as claimed in claim 1, wherein the power contact assembly has:

a power contact element being hollow and having:

a top open end; and a lower end adapted to connect with an external power source; and a connection element having:

a neck sleeved in the lower end of the power contact element and having a top edge;

an annular flange formed on and protruding outwardly and radially from the top edge of the neck and having a top;

multiple through holes formed through the annular flange; and a gasket mounted on the top of the annular flange and having multiple through holes formed through the gasket to respectively correspond to the through holes on the annular flange.

3. The waterproof LED lamp as claimed in claim 1, wherein the upper case further has:

an upper groove annularly formed in the rim of the bottom of the upper case;

two curved walls formed on the bottom of the upper case and surrounded by the upper groove, each curved wall having:

a semicircular portion directly facing that of the other curved wall, wherein each two ends of the two semicircular portions are spaced by a gap; and a straight portion, one end of the straight portion connected with one end of a semicircular portion and the other end of the straight portion bent inwardly to form a hook; and at least one heat-conducting tube, each one of the at least one heat-conducting tubes having:

a semicircular segment, wherein an upper half of the semicircular segment received in the upper groove;

a straight segment connected with the semicircular segment and attached to a corresponding straight portion through a corresponding gap; and an insulation layer sheathed on the straight segment and made from a waterproof and flexible material.

4. The waterproof LED lamp as claimed in claim 3, wherein the lower case further has:

a top edge; and two lower grooves formed in a top edge of the lower case to substantially form a circle aligning with the upper grooves, each lower groove receiving a lower half of the semicircular segment of a corresponding heat-conducting tube.

5. The waterproof LED lamp as claimed in claim 1, wherein the upper case further has multiple upper fins formed on the periphery of the inner collar, extending to connect with the outer collar and mutually spaced; and the lower case further has multiple lower fins mounted around the periphery of the lower case and mutually spaced.

6. The waterproof LED lamp as claimed in claim 1, wherein each lid fixing members has a through hole formed the top lid, each first upper fixing member has a threaded hole formed through the first upper fixing member, and each fixing element is a screw screwed into the threaded hole of a corresponding first upper fixing member through the through hole of a corresponding lid fixing member so that the top lid is fastened on the top edge of the inner collar of the upper case.

7. The waterproof LED lamp as claimed in claim 1, wherein each second upper fixing member has a threaded hole formed through the second upper fixing member, each lower fixing member has a through hole formed through the lower fixing member, each first base fixing member has a through hole formed through the first base fixing member, and each fixing element is a screw screwed into the threaded hole of a corresponding second upper fixing member through the through hole of a corresponding first base fixing member and the through hole of a corresponding lower fixing member so that the base, the lower case and the upper case are fastened together.

8. The waterproof LED lamp as claimed in claim 2, wherein the base further has multiple second base fixing members formed on the bottom edge of the base and respectively corresponding to the through holes of the gasket, and each second base fixing member has a threaded hole formed through the second base fixing member, each fixing elements is a screw screwed into the threaded hole of a corresponding second base fixing member through corresponding through holes of the annular flange and the gasket so that the power contact assembly is fastened on the bottom edge of the base.

9. The waterproof LED lamp as claimed in claim 1, wherein each lower fixing member has:

a top surface having a through hole formed through the top surface;

two walls extending downwardly from two sides of the top surface; and a guide slot formed between the two walls and formed in the inner wall of the lower case to receive a corresponding base fixing member in the guide slot.

10. The waterproof LED lamp as claimed in claim 2, wherein each lower fixing member has:

a top surface having a through hole formed through the top surface;

two walls extending downwardly from two sides of the top surface; and a guide slot formed between the two walls and formed in the inner wall of the lower case to receive a corresponding base fixing member in the guide slot.

11. The waterproof LED lamp as claimed in claim 3, wherein each lower fixing member has:

a top surface having a through hole formed through the top surface;

two walls extending downwardly from two sides of the top surface; and a guide slot formed between the two walls and formed in the inner wall of the lower case to receive a corresponding base fixing member in the guide slot.

12. The waterproof LED lamp as claimed in claim 4, wherein each lower fixing member has:

a top surface having a through hole formed through the top surface;

two walls extending downwardly from two sides of the top surface; and a guide slot formed between the two walls and formed in the inner wall of the lower case to receive a corresponding base fixing member in the guide slot.

13. The waterproof LED lamp as claimed in claim 5, wherein each lower fixing member has:

a top surface having a through hole formed through the top surface;

two walls extending downwardly from two sides of the top surface; and a guide slot formed between the two walls and formed in the inner wall of the lower case to receive a corresponding base fixing member in the guide slot.

14. The waterproof LED lamp as claimed in claim 6, wherein each lower fixing member has:

a top surface having a through hole formed through the top surface;

two walls extending downwardly from two sides of the top surface; and a guide slot formed between the two walls and formed in the inner wall of the lower case to receive a corresponding base fixing member in the guide slot.

15. The waterproof LED lamp as claimed in claim 7, wherein each lower fixing member has:

a top surface having a through hole formed through the top surface;

two walls extending downwardly from two sides of the top surface; and a guide slot formed between the two walls and formed in the inner wall of the lower case to receive a corresponding base fixing member in the guide slot.

16. The waterproof LED lamp as claimed in claim 8, wherein each lower fixing member has:

a top surface having a through hole formed through the top surface;

two walls extending downwardly from two sides of the top surface; and a guide slot formed between the two walls and formed in the inner wall of the lower case to receive a corresponding base fixing member in the guide slot.

17. The waterproof LED lamp as claimed in claim 1, wherein the top lid is made of a transparent material.

18. The waterproof LED lamp as claimed in claim 6, wherein the top lid is made of a transparent material.

19. The waterproof LED lamp as claimed in claim 7, wherein the top lid is made of a transparent material.

20. The waterproof LED lamp as claimed in claim 8, wherein the top lid is made of a transparent material.

* * * * *